United States Patent [19]

Paterson

[11] Patent Number: 4,909,769

[45] Date of Patent: Mar. 20, 1990

[54] ENTERTAINMENT DEVICE

[76] Inventor: Mark R. Paterson, 517 SW. 67th St., Oklahoma City, Okla. 73139

[21] Appl. No.: 294,652

[22] Filed: Jan. 9, 1989

[51] Int. Cl.[4] ..... A41D 27/08

[52] U.S. Cl. ..... 446/28; 2/246

[58] Field of Search ..... 446/26, 27, 28, 372, 446/391, 395; 2/115, 246, 199; 40/286, 425

[56] References Cited

U.S. PATENT DOCUMENTS

| | | | |
|---|---|---|---|
| 1,082,679 | 12/1913 | Connor . | |
| 2,582,699 | 1/1952 | Jelaso et al. . | |
| 4,268,918 | 5/1981 | Lee | 2/189 |
| 4,365,353 | 12/1982 | Rayl | 2/115 |
| 4,710,981 | 12/1987 | Sanchez | 2/115 |
| 4,772,503 | 9/1988 | Donsky | 2/115 X |

*Primary Examiner*—Robert A. Hafer
*Assistant Examiner*—Sam Rimell
*Attorney, Agent, or Firm*—Laney, Dougherty, Hessin & Beavers

[57] ABSTRACT

An entertainment device comprises a garment such as a T-shirt which is sized to be worn closely about the body of a user, indicia formed on the garment depicting at least a portion of an animate object, such as a human face, an elastic member attached to the garment adjacent the indicia for simulating a movable feature of the human face such as a lip or eyelid, and a length of transparent line operably connected to the elastic member for remotely causing an elastic deformation of the elastic member.

10 Claims, 3 Drawing Sheets

ENTERTAINMENT DEVICE

BACKGROUND OF THE INVENTION

1. Field of the Invention.

This invention relates generally to devices for entertaining and amusing the public, and more particularly, but not by way of limitation to novelty T-shirts depicting a portion of an animate object, such as a human face, and having means associated therewith for giving an appearance of animation to the depiction.

2. Description of the Prior Art.

Garments such as T-shirts have in recent years particularly found favor as a means for expressing one's feelings, thoughts, beliefs and personality. A substantial number of these garments have been devoted to entertaining and amusing the public, and as to this number, the prior art discloses several utilizing depictions of a portion of an animate object, such as a human face, and having means associated therewith for giving an appearance of animation to the depiction.

For instance, U.S. Pat. No. 2,582,699 to Jelaso et al. discloses a child's skirt having a sounding novelty such as a calf that moos and that has a movable head which can be actuated by means of a pull-cord extending from the head to a tassle at the waist of the wearer. A tug on the pull-cord activates the downward movement of the head while simultaneously activating the mooing mechanism of the device.

U.S. Pat. No. 4,365,353 to Rayl discloses a body puppet and teaching aid in the form of a T-shirt having indicia depicting a human face. The T-shirt is formed of a resilient material which when stretched causes the indicia to become distorted to illustrate facial expressions. A second embodiment of the T-shirt includes mouth indicia having an elongated slot and a biasing patch affixed to the undersurface of the garment adjacent the slot. The biasing patch is similarly provided with a slot, and an underlying graphic patch is provided for showing teeth and a tongue when the slots in the mouth indicia and biasing patch are opened responsive to the manipulation of the T-shirt material adjacent the mouth.

U.S. Pat. No. 1,082,679 to Connor, while not disclosing such a garment per se, discloses an entertainment device including a badge to be pinned to a lapel or other garment. The badge includes a depiction of a human eye on the front part of a hollow flat box. The device provides for remotely causing the eye to "wink" by manipulation of a rubber bulb or of a string. In the device, the eyelid depiction covers the iris by movement of a plate carrying the eyelid upward relative to the iris, which has been painted or depicted on a stationary portion of the box. This movement is initiated by the user's squeezing a bulb which is in fluid communication with a cylinder carrying the plate or by pulling a string which is connected to the plate and which passes through a hook at the top of the box prior to engaging the plate.

The complexity of the devices disclosed in the Connor and Jelaso et al. patents cited above, however, make such devices relatively impractical from a mass production standpoint. Garments that are made of a lightweight fabric or that are designed to be worn close to a user's body cannot be comfortably used in these devices, moreover, as both devices utilize rigid or semi-rigid moving parts.

The device disclosed in the Rayl patent while relatively simple to manufacture is, nevertheless, useful only for a limited range of fabrics, and lacks a certain realism in producing the desired effect of animation in that a user must manually stretch the fabric adjacent the indicia on the T-shirt. Moreover, repeated stretching of the fabric may in time reduce the resiliency of the garment, so that the effectiveness of the device in replicating life is diminished and the shape of the garment itself possibly distorted.

There is a need, then, for an entertainment device which includes a garment such as a T-shirt which is suitable for mass production in a variety of fabrics, relatively inexpensive to manufacture, and comfortable for a wearer, where the effectiveness of the entertainment device as such or as a garment is not easily or irretrievably lost by use of the device.

SUMMARY OF THE INVENTION

The present invention solves these aforementioned needs and others by providing a novel and improved entertainment device. The device of the present invention comprises a garment such as a T-shirt which is sized to be worn closely about the body of a user, indicia formed on the garment depicting at least a portion of an animate object, animating means for giving an appearance of animation to the indicia, and actuating means for remotely actuating the animating means.

The animating means is preferably attached to the garment adjacent the indicia for simulating a movable feature of the portion of the animate object that is depicted. For instance, where the depicted portion of an animate object comprises a human face, an elastic member in the general configuration of a lip or eyelid may be attached to the T-shirt adjacent indicia depicting a mouth to simulate these features of the human face.

The animating means preferably also comprises a segment of elastic string extending between the garment and the elastic member just mentioned, which string contributes to the effective movement of the elastic member in simulating a lip or eyelid, as will be described subsequently. A semi-rigid shaping member is preferably joined to the elastic member for assisting in shaping the elastic member into its proper configuration.

The actuating means of the present invention includes a length of transparent line operably connected to the animating means, as for example to the elastic member or the shaping member just described, and attachable to a remote portion of a user's body or to a second garment. Where the device of the present invention includes a T-shirt, this may involve, for example, tying the line to a user's foot or shoe such that in walking or in some other movement of a user's foot the indicia may achieve an appearance of animation without any apparent effort on the part of a user.

It is an object of the present invention to provide an entertainment device including a garment which is relatively simple to construct, and further which lends itself to mass production in a variety of comfortable and fashionable fabrics.

It is also an object of the present invention to provide such a device which is relatively inexpensive to make and which does not easily or irretrievably lose its effectiveness as an entertainment device or as a garment by use of the device.

Other objects and advantages will become more readily apparent to those skilled in the art on consideration of the following description of the preferred embodiments and accompanying drawings, wherein like elements and features have been given like reference numerals.

DETAILED DESCRIPTION OF THE PREFERRED EMBODIMENTS

Figure 1:
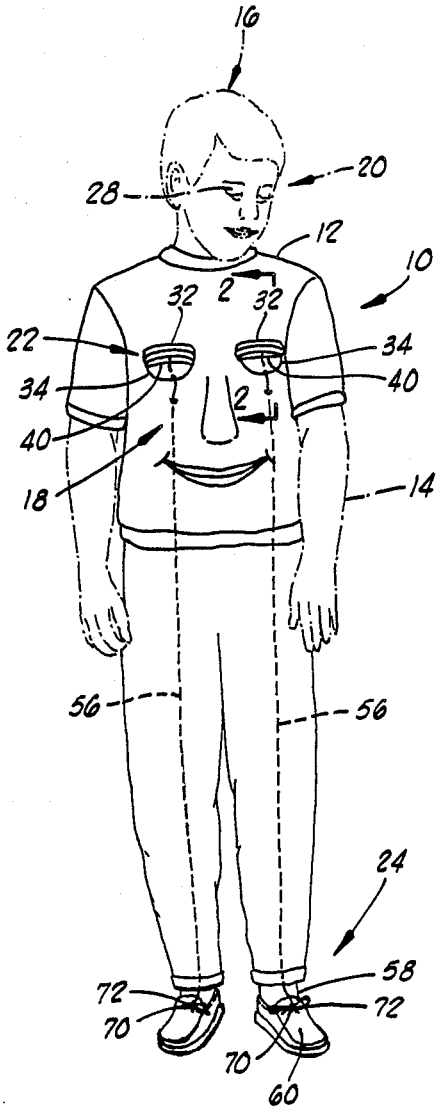
FIG. 1 is a front view of a first embodiment of the invention.

Referring now to the drawings, and more particularly to FIGS. 1-8, the entertainment device of the present invention is illustrated and generally designated by the numeral 10. As best shown in the first and second embodiments of FIGS. 1 and 4, the entertainment device 10 generally comprises a garment such as a T-shirt 12 sized to be worn closely about the body 14 of a user 16, indicia 18 formed on the T-shirt 12 depicting at least a portion 20 of an animate object, animating means 22 for giving an appearance of animation to the indicia 18, and actuating means 24 for remotely actuating the animating means 22.

Figure 2:
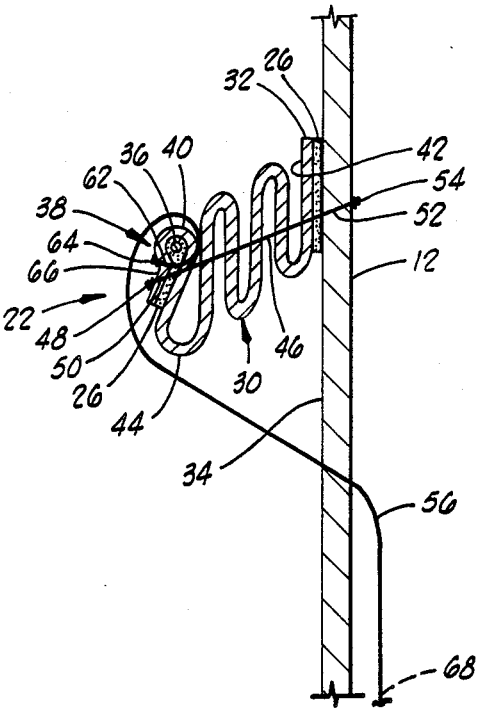
FIG. 2 is an enlarged cross-sectional view of the first embodiment, taken along lines 2—2 in FIG. 1, showing a possible construction of the first embodiment.
Figure 3:
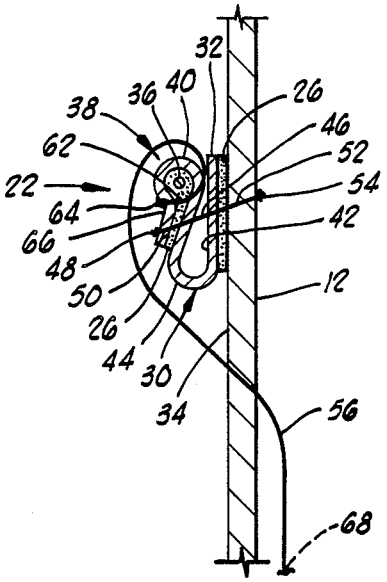
FIG. 3 is an enlarged cross-sectional view of a preferred construction of the first embodiment of the present invention, again taken generally along lines 2—2 in FIG. 1.

A first embodiment of such an entertainment device 10 is shown by FIGS. 2 and 3 in two possible constructions. In both constructions, the animating means 22 of the device 10 is attached to the T-shirt 12 adjacent the indicia 18 by a bonding agent 26 for simulating a movable feature such as an eyelid 28 of the face which comprises the depicted portion 20 of an animate object. The animating means 22 so situated comprises an elastic member 30 which from the perspective of a viewer of the device 10 has the general configuration of the eyelid 28.

Preferably this appearance is achieved by constructing elastic member 30 of an elastically deformable fabric so that the elastically deformable fabric member 30 which results will visually blend into the fabric background of the T-shirt 12. The top edge 32 of the member 30 is curved to suggest the presence of an eye socket, and the member 30 is folded either in the multiple fold arrangement of FIG. 2 or, preferably, in the single fold arrangement of FIG. 3. This folding is necessary to insure that the eye 34 of the first embodiment is not obscured by the fabric member 30 before the device is actuated, and to simulate as nearly as possible the gathering of the eyelid 28 of an actual human eye before a "blink" or "wink". A semi-rigid shaping member 36 is bonded within a terminal fold 38 of the member 30 to give the edge 40 of the member 30 definition and to otherwise assist in the shaping of the member 30 into its desired configuration.

Because of the folding of the fabric member 30, the outer surface 42 and the inner surface 44 of the member 30 relative to the T-shirt 12 are preferably of the same color. This feature is designed to prevent the folding of the member 30 from being readily apparent to a viewer of the device 10, and to create the illusion that the member 30 and the eye 34 are within the same plane, so that when the animating means 22 is actuated the member 30 appears to come from within the T-shirt 12 and from above the eye 34 in the same fashion as eyelid 28 with respect to the actual eye it covers.

The animating means 22 of the first embodiment further comprises a segment 46 of elastic string extending between the T-shirt 12 and fabric member 30. The segment 46 is placed into position by tying a small knot 48 at a first end 50 of segment 46, using a needle to carry the second end 52 of segment 46 through the folds of member 30 and T-shirt 12, and placing a second small knot 54 at the second end 52 of segment 46. This construction permits the segment 46 to compress the folds of member 30 before the device 10 is actuated and to aid the recovery of the member 30 to this beginning position after the device 10 has been actuated. It is contemplated that such a segment 46 may not be necessary, however, where member 30 itself possesses sufficient elasticity to recover its beginning position independently.

Figure 7:
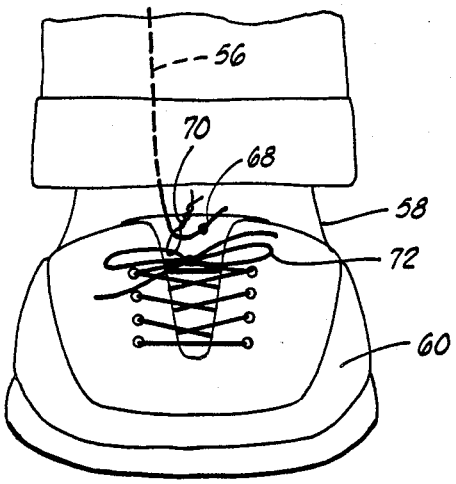
FIG. 7 is an enlarged view of a first construction of a common portion of the first and second embodiments of the invention.
Figure 8:
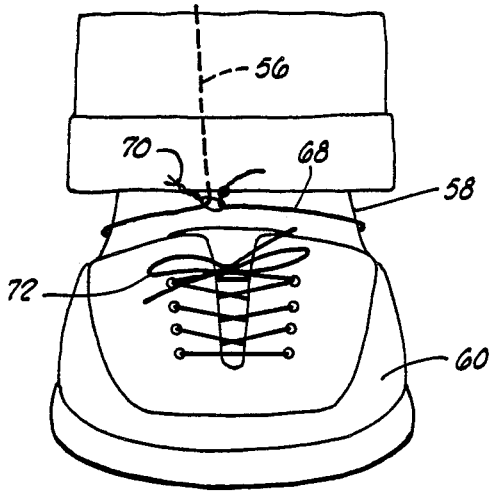
FIG. 8 is an enlarged view of a second construction of the common portion depicted in FIG. 7.

The actuating means 24 of the first embodiment in both of the depicted constructions comprises a length 56 of transparent line which is operably connected to the animating means 22 described above, and which is attachable to a remote portion of the user's body such as a foot 58 or to a second garment such as a shoe 60. The length 56 of line is knotted at a first end 62, and the resulting knot 64 is positioned at an outer edge 66 of the terminal fold 38 facing a viewer of the device 10. A needle carries a second end 68 of the line through the terminal fold 38 beneath shaping member 36, back around the terminal fold 38 and the shaping member 36 held therein, and through the T-shirt 12. The length 56 of line is then attached to the user's foot 58 or to his shoe 60, or to some other remote portion of the user's body or second garment, as shown in FIGS. 7 and 8.

The length 56 of line in the first preferred embodiment is equipped with a conventional twist-tie 70 which is securely wrapped around or otherwise connected to the second end 68 of the length 56 of line. To attach the length 56 of line to the user's foot 58 (FIG. 8) or shoe 60, then, the user may simply wrap the twist-tie 70 around a shoe lace 72 (FIG. 7), while wrapping excess line provided for taller users around the twist-tie 70 and folding a portion of the twist-tie 70 over the wrapped excess line.

The user of the first embodiment as thus constructed can actuate the animating means 22 by taking a step or otherwise moving his foot 58 and shoe 60. This action creates a tension on the length 56 of line and on elastic member 30, creating a downward movement of member 30 and terminal fold 38 in particular, and obscuring the eye 34. This movement is resisted by the segment 46 of elastic string, which aids in the recovery of the member 30 to its former shape as the user's foot 58 rises to take another step. The downward movement of the user's foot 58 again operates to draw the member 30 down across the eye 34, and so forth and so on, so that a "winking" or "blinking" eye is effectively simulated and an appearance of animation is imparted to the indicia 18.

Alternatively, the length 56 of line and the twist-tie 70 can be concealed from view at the periphery of the T-shirt 12 or of a second garment. The provision of the twist-tie in this circumstance permits the user to locate and manually manipulate the length 56 of line without being unduly obvious in actuating the device 10 and while sitting down, for instance.

Figure 4:
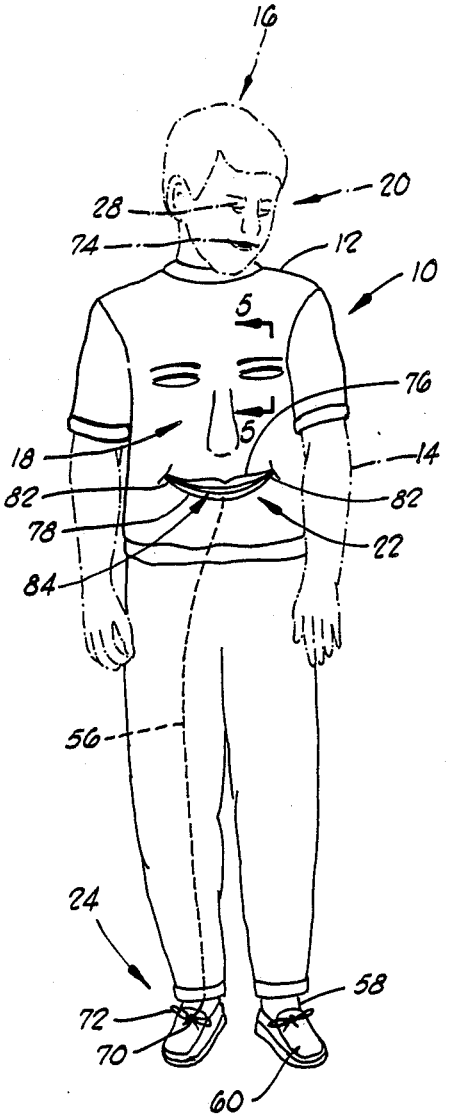
FIG. 4 is a front view of a second embodiment of the present invention.
Figure 5:
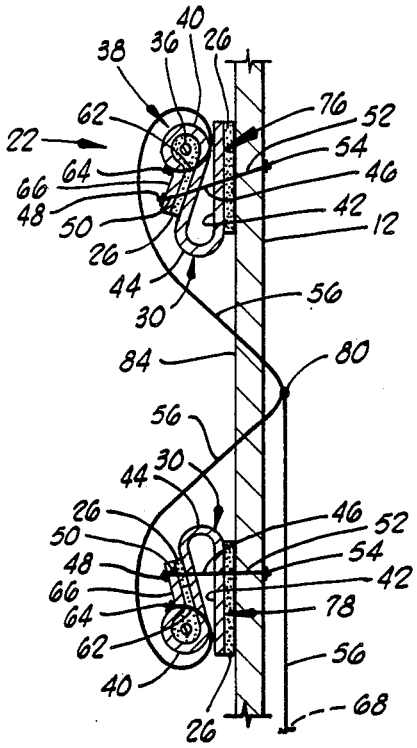
FIG. 5 is an enlarged cross-sectional view of a possible construction of the second embodiment taken along lines 5—5 in FIG. 4.
Figure 6:
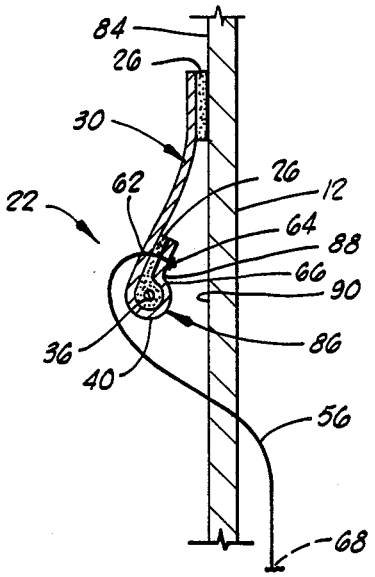
FIG. 6 is a preferred construction of a preferred construction of the second embodiment, taken generally along lines 5—5 in FIG. 4.

A second embodiment of the device 10 of the present invention and two possible constructions thereof are shown in FIGS. 4–6. In the second embodiment, a lip 74 rather than an eyelid 28, is the movable feature of the portion 20, which in the second embodiment also comprises a human face, that is simulated.

Referring now to FIG. 5, a possible construction of the second embodiment is shown which simulates the upper and lower lips 74 of a human face. The putative upper lip 76 utilizes a construction which is identical to that disclosed in connection with FIG. 3 above. The putative lower lip 78 merely inverts this construction, with the lengths 56 of transparent line associated with the lips 76 and 78 being tied together in a knot 80 to coordinate the movements of the members 30 of lips 76 and 78. The appearance of this construction of the second embodiment of the device 10 is thus of pursing lips 74 or the like.

A preferred construction of the second embodiment of the device 10 is illustrated in FIG. 6. In this construction, a lower lip 74 is simulated by a generally crescent-shaped member 30 which is bonded to the T-shirt 12 only at the corners 82 of the depicted mouth 84, as best seen in FIG. 4. A semi-rigid shaping member 36 is bonded within a fold 86 of the member 30, assisting in shaping the fabric member 30 into its generally crescent-shaped configuration.

The actuating means 24 of the construction shown in FIG. 6 comprises, as before, a length 56 of transparent line which is operably connected to the animating means 22 of the construction and which is attachable to a remote portion of the user's body such as a foot 58 or to a second garment such as a shoe 60. The length 56 of line has a knot 64 at a first end 62 of the line, with the knot 64 being positioned at an inner edge 88 of the fold 86. A needle carries the second end 68 of the line through the fold 86 above the member 36, around the fold 86 and member 36, and through the T-shirt 12 downward where the line may be attached to the user's foot 58 or shoe 60.

A downward movement of the user's foot 58 creates a tension on the length 56 of line and on member 30 to which it is operably connected. The member 30 stretches downward in response, thereby exposing a portion 90 of the indicia formed on the T-shirt and depicting a mouth. This portion 90 may comprise a depiction of additional teeth or of the interior of the depicted mouth, as desired. It should be noted that for the upper lip 74 in the preferred construction of the second embodiment animation is not simulated, but the upper lip 74 is merely depicted as a feature of the portion 20 on T-shirt 12.

It can be seen from the foregoing description that other constructions may be devised or the above constructions adapted to depict a large variety of animate objects and to give an appearance of animation to those depictions, while accomplishing the objects and realizing the advantages mentioned as well as those which are inherent in the present invention.

In this regard, it is specifically noted that the indicia depicting these animate objects or portions thereof may be painted, printed, or otherwise formed on a wide variety of garments and fabrics according to conventional mass production methods for novelty T-shirts. The animating means and actuating means of the present invention may then be added to the garments with relatively little difficulty.

It can be seen also that the animating and actuating means may be replaced with some ease, as where the length of transparent line as described above breaks in a particular construction and a new length of line is sewn into place.

Accordingly, while preferred embodiments of the invention have been described for the purpose of this disclosure, changes in the construction and arrangement of parts can be made by those skilled in the art, which changes are encompassed within the spirit of this invention, as defined by the appended claims.

What is claimed is:

1. An entertainment device comprising:
a garment sized to be worn closely about the body of a user;
indicia formed on said garment depicting at least a portion of an animate object;
animating means, attached to said garment, for giving an appearance of animation to said indicia, said animating means comprising a folded elastic member in the general configuration of said animate object; and
actuating means attached to said elastic member for remotely actuating said animating means and unfolding said elastic member.

2. The device of claim 1, wherein said animating means is attached to said garment adjacent said indicia for simulating a movable feature of said portion of said animate object.

3. The device of claim 1, wherein said actuating means comprises a length of transparent line operably connected to said animating means.

4. The device of claim 1, wherein said garment comprises a T-shirt.

5. The device claim 1, wherein said portion of an animate object comprises a human face.

6. An entertainment device comprising:
a garment sized to be worn closely about the body of user;
indicia formed on said garment depicting at least a portion of an animate object;
a folded elastically deformable fabric member attached to said garment adjacent said indicia for simulating a movable feature of said portion of said animate object;
a semi-rigid shaping member joined to said fabric member for assisting in shaping said fabric member into the general configuration of said movable feature; and
a length of transparent line operably connected to said fabric member for remotely causing an elastic deformation of said fabric member such that said fabric member is unfolded.

7. The device of claim 6, wherein said portion of an animate object comprises a human face.

8. The device of claim 7, wherein said movable feature of said human face is selected from a group consisting of lips and eyelids.

9. An entertainment device comprising:

a garment sized to be worn closely about the body of a user;

indicia formed on said garment depicting at least a portion of an animate object;

animating means, attached to said garment, for giving an appearance of animation to said indicia and for simulating a movable feature of said portion of said animate object, said animating means comprising;

an elastic member in the general configuration of said feature; and a segment of elastic string extending between said garment and said elastic member; and actuating means for remotely actuating said animating means.

10. An entertainment device comprising:

a garment sized to be worn closely about the body of a user;

indicia formed on said garment depicting at least a portion of an animate object;

an elastically deformable fabric member attached to said garment adjacent said indicia for simulating a movable feature of said portion of said animate object;

a semi-rigid shaping member joined to said fabric member for assisting in shaping said fabric member into the general configuration of said movable feature;

a segment of elastic string extending between said garment and said fabric member; and a length of transparent line operably connected to said fabric member for remotely causing an elastic deformation of said fabric member.

* * * * *